United States Patent [19]

Höroldt et al.

[11] 4,420,572

[45] Dec. 13, 1983

[54] CONTINUOUS PROCESS FOR THE PRODUCTION OF HIGHLY CONCENTRATED SPINNING SOLUTIONS OF ACRYLONITRILE POLYMERS AND A SUITABLE DEVICE FOR THIS PURPOSE

[75] Inventors: Ernst Höroldt; Helmut Vollmüller, both of Kelkheim; Heinz D. Bernhard, St. Goar; Harald M. Strobel, Flörsheim am Main, all of Fed. Rep. of Germany

[73] Assignee: Hoechst Aktiengesellschaft, Frankfurt am Main, Fed. Rep. of Germany

[21] Appl. No.: 331,805

[22] Filed: Dec. 17, 1981

[30] Foreign Application Priority Data

Dec. 19, 1980 [DE] Fed. Rep. of Germany ..... 3048059

[51] Int. Cl.[3] ..... C08J 3/08

[52] U.S. Cl. ..... 523/322; 422/269; 422/901; 523/315; 523/318; 523/324

[58] Field of Search ..... 523/312, 315, 318, 319, 523/322, 323, 324; 422/901, 269, 271

[56] References Cited

U.S. PATENT DOCUMENTS

| | | | |
|---|---|---|---|
| 2,390,898 | 12/1945 | Rechtin | 422/269 |
| 2,573,949 | 11/1951 | Blizzard | 422/901 |
| 3,630,985 | 12/1971 | Takeya | 523/319 |

*Primary Examiner*—Paul R. Michl

*Attorney, Agent, or Firm*—Curtis, Morris & Safford

[57] ABSTRACT

The invention relates to a process and device for the production of highly concentrated spinning solutions from acrylonitrile polymers, where the dissolving is carried out in one step in a stirred mixing vessel, which has a disc-shaped stirrer rotating in a horizontal plane, the polymeric material to be dissolved and the solvent are metered in separately at room temperature into the stirring vortex which is formed, and the temperature of the solution being formed is maintained at a constant preset value in the range from 60° to 120° C. by controlling the peripheral velocity of the stirrer.

3 Claims, 2 Drawing Figures

Figure 1:
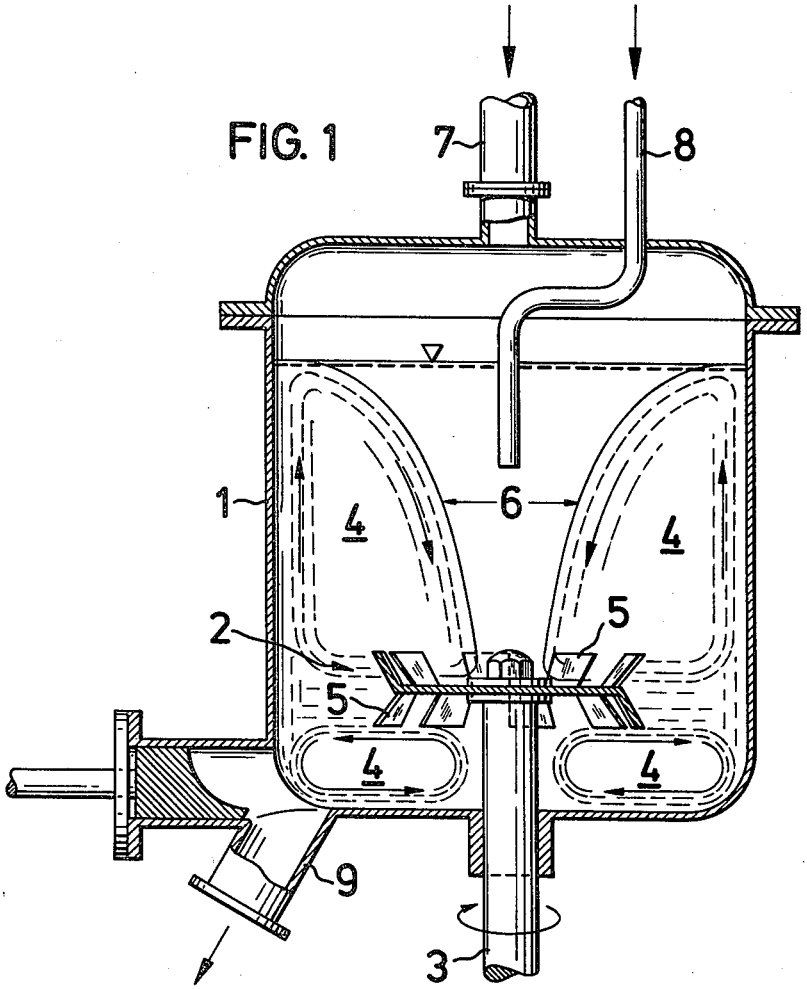

CONTINUOUS PROCESS FOR THE PRODUCTION OF HIGHLY CONCENTRATED SPINNING SOLUTIONS OF ACRYLONITRILE POLYMERS AND A SUITABLE DEVICE FOR THIS PURPOSE

The invention relates to a one-step, continuous process for the production of spinning solutions of acrylonitrile polymers in a single stirred mixing vessel.

The spinning of polymers and copolymers of acrylonitrile, by a wet or dry spinning method, requires a suitable spinning solution. The quality of the spinning solution has a considerable influence on the course of the spinning and after-treatment processes and also on the properties of the resulting fibers or filaments.

Homogeneous spinning solutions of higher molecular weight, fiber-forming polymers can be produced only with difficulty in the required high concentrations which are desired for spinning and they require dissolving processes which are in most cases multi-stage and which in some cases can only be worked discontinuously. For the production of polyacrylonitrile spinning solutions, in general the polymer is initially suspended in the strongly cooled solvent present, and the dissolving step proper is then carried out with heating and stirring in a second unit. This process has a number of disadvantages. In order to obtain a homogeneous spinning solution, a suspension has to be obtained first which does not contain swollen or incipiently dissolved polymer particles which would cause the formation of a gel or of lumps in the solution. Inhomogeneities of this type cannot usually be removed completely even by prolonged stirring, heating-up and repeated filtration. The possibility that the polymer particles will dissolve incipiently during the suspending cannot usually be ruled out completely, even if the solvent present has been cooled to well below room temperature, that is to say, for example, to 0°--20° C. The danger of the formation of lumps arises in particular when readily soluble polyacrylonitrile polymers having particle sizes below 50 μm have to be suspended. A further important disadvantage of this process is the relatively long heating-up time required for the production, from the suspension, of the actual solution. This causes long residence times at temperatures of, for example, 100° C., which by themselves can cause thermal damage to sensitive polymers and yellowing of the spinning solution. Fibers or yarns produced therefrom then have, inter alia, a poor degree of whiteness.

The production of the polymer suspension is customarily carried out in kneaders or in vessels having low-speed mixers, in order to avoid as far as possible an increase in temperature and the associated undesired incipient dissolving and swelling of the polymer particles. Another disadvantage of the process described is the large amount of cooling and heating energy required. The pre-cooled suspensions must be brought to the dissolving temperature. When the suspension turns into a solution, a very viscous phase which requires powerful stirrer drives is passed through below the dissolving temperature. The vessels in which the suspending and dissolving is carried out must also be provided with the appropriate cooling or heating equipment for the purpose of temperature control.

As is evident from German Offenlegungsschrift No. 2,901,860, sparingly soluble polymers of acrylonitrile can also be suspended in solvents at room temperature.

In a second step this suspension is then heated in separate devices to temperatures of at least 130, but preferably 150° C. This high temperature must be maintained at least for some minutes in the polymer solution, in order to complete the dissolving process. Thereafter further mixers or similar devices have to be used in order to level out the inhomogeneities of the polymer solutions thus obtained.

German Offenlegungsschrift No. 2,645,318 provides another process for the production of polyacrylonitrile polymer solutions, in which process a cold suspension of acrylonitrile polymer in an organic solvent is prepared in the intake section of a twin-screw device. The suspension thus obtained is heated in the subsequent extruder sections to temperatures of 110°-150° C. and subjected to the action of powerful shear forces. We have found that this process can be used only to a limited extent and under special conditions. One essential condition is that the polymer used has a minimum particle size of about 100 μm and it must also have certain dissolving characteristics. Polymeric products containing dust-like or fine polymer particles or even relatively coarse polymer particles do not produce the required suspension in the intake part of the twin-screw device, but cause blocking of the dissolving screws and cracking of the polymer material. The possibilities of using in industry a twin-screw extruder for dissolving acrylic polymeric products are also restricted, for example by the fact that the optimum selection of the multi-part screw segments must be changed in accordance with variations in the molecular weight of the polymer, in through-puts and in concentrations of the spinning solution. The use of such twin-screw devices is also very expensive and susceptible to faults.

The use of numerous other units, for example the use of mixing turbines and dispersing equipment having rotors which run at very high speeds (revolutions between 1,500 and 10,000 rpm), has also already been proposed for the production of suspensions from polyacrylonitrile polymers and appropriate organic solvents. All these units have the deficiency that they can only process specific polymeric products having a certain composition and particle size. In addition, the suspensions produced with units of this type must then be subjected in a second process step to a heat treatment and to a stage having relatively long residence times in which the dissolving is completed. Polymers which are readily soluble or which, because of their small particle size, have a very large surface area are dissolved incipiently or swollen incipiently when such machines are used, the incipiently swollen material cakes, after a short running time, onto the housing walls, the rotors, stator parts, support bars and shafts and usually within a short time causes complete blockage. Such machines are therefore not suitable for long-term use.

East German Patent Specification No. 8,944 discloses a process and a device for dissolving acrylic polymers, in which the otherwise already known processing steps of stirring, kneading and grinding are carried out in one vessel. An extremely complex piece of equipment is disclosed there which makes it possible to carry out the individual working steps, which are usually carried out in several different devices, within one vessel, which is equipped, for example, with a flow cylinder, with a intake screw, with a grinding unit and further stirring devices. In order to keep the amount of deposits and lump formation within limits, it is advisable to equip not only the vessel housing with a heating jacket, but also the baffle and the various stirring units, in order to avoid caking-on or gelling if possible.

There was therefore still the object of finding a process which works on a continuous basis, and devices suitable for this purpose, in which acrylic polymers can be processed, in one vessel and by the use of a stirring unit which is as simple as possible, in one step into spinning solutions which are free from gel particles or swollen and incipiently dissolved polymer particles. Only when using such a process is it to be expected that the spinning solutions obtained can be spun readily and guarantee, inter alia, long filter lives and jet running times.

It has now been found, surprisingly, that it is possible, contrary to the indications of the prior literature, to produce acrylonitrile polymer spinning solutions of the quality desired continuously in a one-step dissolving process, provided a stirred mixing vessel is employed which has a disc-shaped stirrer. This stirrer should rotate in a horizontal plane and have peripheral velocities of about 4 to about 25 m/sec in order to stir this solution vigorously with the formation of a stirring vortex. The polymeric product to be dissolved and the solvent are metered separately into the vortex which is forming and the finished spinning solution is continuously discharged at the bottom of the stirred mixing vessel at such a rate that the liquid level in the vessel remains constant. The stirred mixing vessel does not normally have heated or cooled surfaces or parts. The desired dissolving temperature, which is preferably in the range from 50°–120° C., is established on the contrary solely by the frictional heat generated by the rotating stirrer. A specific dissolving temperature is maintained by adjusting the peripheral velocity of the stirrer within the abovementioned limits, that is to say within the range in which a stirring vortex is still formed with certainty. The size of the vessel or the liquid level have to be so chosen that the average residence time of the polymer in the stirred mixing vessel is about 5 to 30 minutes.

The required vigorous mixing of the solution with the metered-in polymeric product and the solvent and the required formation of a marked stirring vortex are achieved if the disc-shaped stirrer has a diameter of about 0.3 to 0.9 times the internal vessel diameter at the height of the stirring plane and the distance of the disc from the vessel bottom is about 0.5 to 1 times the stirrer diameter and the liquid level depth is 0.8 to 3 times the stirrer diameter. ;p The viscosity of the spinning solution can be within the range from 10 to about 200 Pas, in accordance with the requirements of the subsequent spinning process. In general a viscosity range from 30 to 100 Pas is preferred. The formation of a stirring vortex, required according to the invention, depends of course on the viscosity of the solution produced. The required peripheral velocities of the stirrer of 4 to about 25 m/sec can be shifted somewhat at extreme values of the viscosity of the solution produced. Peripheral velocities of the stirrer of 7 to 20 m/sec are preferred.

Examples of the disc-shaped stirrer which have proved suitable are toothed discs or discs which approximately have the shape of the blade of a buzz saw. Such stirrers are commercially available in various designs and they need not have the shape of a solid disc, but those tools are also suitable, where the disc is perforated with individual holes or which have a knurling or the like on their disc surface.

It is necessary for the formation of a sufficiently large stirring vortex and for a thorough mixing effect that the disc-shaped stirrer rotates in an approximately horizontal plane. However, it is not necessary to carry out an exact alignment to ensure that the path of the stirrer is horizontal, because a certain amount of deviation from the horizontal does not have any effect on either the formation of the central stirring vortex or the vigorous mixing effect.

The method selected for feeding in the polymeric material and the separate feeding in of the solvent into the stirring vortex which forms in the center cause an immediate wetting and dissolving of the individual particles of the polymeric material. It is therefore not necessary to use cooled solvent and prior pasting or suspending. The temperature of the solution in the vessel is determined in general by the subsequent process steps, such as, for example, by the temperature required for spinning. The temperature of the solution is further influenced by the solubility of the polymer to be dissolved and by the desired concentration of the spinning solution. The desired temperature, which is in general between 50° and 120° C., preferably between 60° and 90° C., is brought about and maintained in the solution by the stirring energy or frictional energy of the disc-shaped stirrer. It is thus possible constantly to maintain the temperature at the desired value if the peripheral velocity of the stirrer is adjusted appropriately; for example if the temperature increases beyond the desired set point, the peripheral velocity has to be reduced correspondingly, whilst in the case of a solution temperature which is too low the peripheral velocity has to be increased correspondingly. This control can be automated with the aid of commercially available devices.

However, care has to be taken in the case of this automatic control that the peripheral velocity of the stirrer cannot assume just any values. The stirring velocity must be sufficient in each case to ensure effective mixing of the vessel contents and formation of an adequate stirring vortex. Thus, if the value of the peripheral velocity drops below about 4 m/sec, a vortex formation and mixing action which are too low are observed in general, whilst at peripheral velocities markedly higher than 25 m/sec, in particular in the case of highly viscous solutions, the mixing effect also decreases, since the stirrer then rotates without sufficient contact with the vessel contents.

If a chosen stirrer does provide the required thorough mixing and the formation of a well defined vortex, but the interaction with the vessel contents fall short of achieving a sufficiently high dissolving temperature, the stirrer has to be replaced by another one, which permits a greater interaction with the vessel contents. For example, if the temperature was not achieved with a given stirrer, then it should be replaced, for example by another stirrer having a larger stirring resistance. The corresponding converse procedure is followed if the interaction between the disc-shaped stirrer and the vessel contents is so large, even at low peripheral velocities, that a desired temperature can no longer be safely maintained without jeopardizing the mixing effect and the formation of a vortex.

The rotation of the disc-shaped stirrer in an at least approximately horizontal plane forces the vessel contents to undergo various circulating motions, as is evident, for example, from FIG. 1. For example, the polymer powder metered into the vortex and the solvent are caught up by the flow of the vessel contents which is directed above the rotating disc-shaped stirrer towards the walls of the vessel. The flow of material then proceeds upwards along the walls of the housing and then changes direction and heads back at an angle towards the center of the stirrer. A second circulation of the material takes place below the disc-shaped stirrer and proceeds from the stirrer to the walls of the vessel, from there downwards along the vessel walls towards the bottom of the mixing vessel and it then rises again in the vicinity of the central axis.

Such a flow configuration with a very pronounced stirring vortex can only be maintained, if the diameter of the stirrer is maintained in a certain ratio to the internal diameter of the mixing vessel, at a certain distance of the stirrer from the bottom, and if a certain feed-in height is maintained.

Trials have shown that the largest diameter of the stirrer must be in a range which corresponds to 0.3 to 0.9 times the internal vessel diameter at the height of the stirring plane, whilst the distance of the stirrer from the vessel bottom should be 0.5 to 1 times the stirrer diameter. The liquid level should be 0.8 to 3 times the stirrer diameter, preferably 1 to 2 times this diameter. Particularly good results were obtained, if the distance of the stirrer from the vessel bottom is 0.5 times, and the liquid level about 1.2 times, the stirrer diameter.

Liquid level depth is understood as meaning here the maximum depth of the liquid level in the stirred mixing vessel, that is to say a liquid level as observed close to the walls of the vessel when the vortex has been formed.

Acrylic polymers and copolymers of the most diverse particle size, from dust to granules, can be dissolved by the process claimed, at, for example, 80° C., to give gel-free spinning solutions having a viscosity between about 10 and 200 Pas, preferably 30 to 100 Pas. During the production of highly concentrated solutions, the temperature of the solution should not drop below 75° C., since gelling can occur with solutions of this type below this temperature. As has already been mentioned above, the average residence time of the polymer molecules in the dissolving vessel is between 5 and 30 minutes, preferably 15 to 20 minutes. Under these conditions even thermally sensitive polymers can be dissolved without being damaged.

The stirred mixing vessel required for carrying out the process according to the invention has a vertical stirrer shaft, on which a disc-shaped stirrer is mounted which then rotates in an approximately horizontal plane, and in which stirrer shaft, which is preferably introduced from below into the stirring vessel, is provided with a controllable drive which permits the setting of peripheral stirrer velocities from about 4 to about 25 m/sec. Separate feeds for the solvent and the polymeric material are so arranged in the head part of the vessel that the materials metered in can be added as close as possible to the central axis of the vessel. The discharge points of these metering lines should end above the proposed solution level in the vessel in order to avoid soiling or the formation of deposits on the pipes. The stirred mixing vessel according to the invention must have, on its bottom side, a device for discharging the polymer solution, the discharging rate of which can be controlled in response to the liquid level depth. Such a discharge device can consist of, for example, a bottom valve and a gear pump which can be driven by a controllable drive. In order to maintain a constant liquid level depth, measuring instruments of the customary design can be used, for example liquid level measuring devices which respond to the absorption of radioactive radiation or, for example, pressure pick ups, with which the total weight of the stirred mixing vessel inclusive of contents can be measured. The dimensions of the disc-shaped stirrer should be such that the external diameter of the stirrer is approximately 0.3 to 0.9 times the internal vessel diameter at the height of the stirrer plane and the distance of the stirrer from the bottom of the vessel should be approximately 0.5 to 1 times the stirrer diameter. The height of the vessel should be larger than the optimum liquid level depth, which is about 0.8 to 3 times the largest diameter of the stirrer.

As has already been mentioned above, heating or cooling of the solution by external temperature-controlling devices, such as, for example, double-walled design of the stirred mixing vessel or the like, is not necessary. In particular, however, neither are there any further inserts intended to improve the mixing effect to be provided in the stirred mixing vessel. Such inserts in general only cause deposits of polymer particles to form. Such encrustations can then dissolve from time to time and cause a contamination of the spinning solution produced.

An advantage of the process according to the invention and the device used in it is the continuous mode of operation, and regular interruptions for cleaning the stirred mixing vessel are not necessary. When the dissolver is started up for the first time, the procedure can be, for example, that initially a part of the required amount of solvent is introduced and an elevated addition of the polymeric material is then commenced at an increased rate. Particularly good results have been obtained when a dilute spinning solution was introduced and initially heated up by running the stirrer and only then was the actual continuous metering-in commenced.

The mode of action and the design principle of the stirred mixing vessel are shown in FIG. 1. The actual vessel 1 does not contain any inserts which impede the flow pattern. The disc-shaped stirrer 2 is driven by a vertical shaft 3, which has been introduced through the bottom of the vessel 1. The disc-shaped stirring element makes contact with the vessel contents 4 in particular via the splayed teeth 5 of the disc-shaped stirrer 2. A flow pattern, indicated with arrows, is thus forced onto the vessel contents 4. This rotational movement of the disc-shaped stirrer 2 causes in particular the formation of a vortex 6, in which the metering line 7 for the addition of the polymeric material and the metering line 8 for the solvent end. The discharge device 9 is represented in this figure only as a bottom outlet valve, whilst a conveying device, for example a gear pump, connected to it has been omitted.

Figure 2:
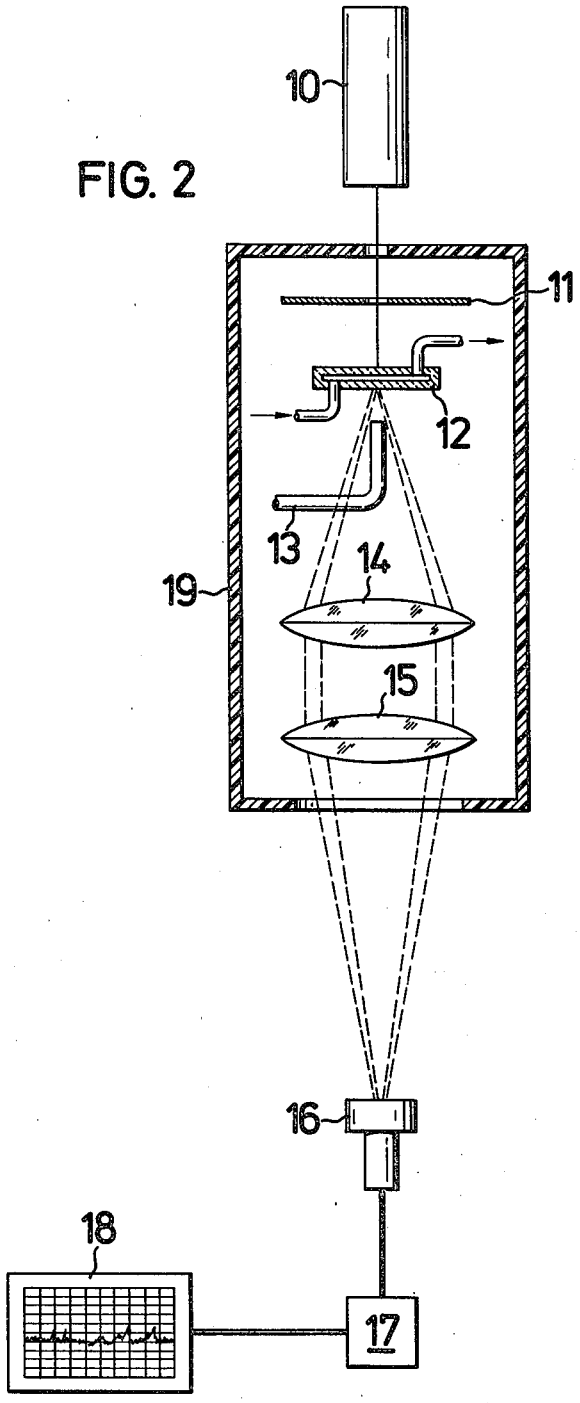

The quality of the spinning solutions produced was assessed, for example, by determining the gel particles by a light-scattering method. The measurement arrangement is evident from FIG. 2. An He-Ne laser 10, the light beam of which was guided through the aperture of a temperature-controlled instrument housing 19, served as the light source. Behind the aperture there was a pinhole diaphragm 11 and behind that a flow cuvette 12. Samples of the spinning solution were forced through this flow cuvette 12, which had a path length of 1 mm, at a through-put rate of 1.5 g/min. The core beam was then blocked out with the aid of the diaphragm 13. The scattered light caused by the inhomogeneities was aligned in the collector lenses 14 and 15 and directed to a photocell 16. The signals received there were transformed in a measuring instrument 17 and amplified and made visible on the recorder 18. The measuring time per sample was 30 minutes. Investigations have shown that a spinning solution can be considered readily spinnable and virtually free from gel particles, if fewer than 5 inhomogeneities are recorded during this measuring time of 30 minutes.

The process according to the invention and the corresponding device can be used for producing highly concentrated polymer solutions from the known homopolymers of acrylonitrile and copolymers with, for example, at least 60% acrylonitrile building units and corresponding unsaturated monomers, which can be copolymerized with acrylonitrile, such as, for example, methyl acrylate, styrene, vinylidene chloride or sodium methallyl-sulfonate. Additives which cannot be polymerized, such as, for example, titanium dioxide pigments, color pigments and modifiers, can also be added to the dissolving equipment.

The examples described below are intended to illustrate the invention in more detail.

Unless otherwise indicated, data in percentages and parts refer to amounts by weight.

EXAMPLE 1

19.8 kg/h of an acrylonitrile copolymer, which had been produced by an aqueous precipitation polymerization from 94.4% of acrylonitrile, 5.0% of methyl acrylate and 0.6% of sodium methallyl-sulfonate and had a relative viscosity of 1.95 (measured at 20° C. on a 0.5% strength solution in dimethylformamide), were added continuously, via a powder conveying device, to a stirred vessel, into which at the same time 40 kg/h of dimethylformamide were added with the aid of a piston metering pump. The particle size of the polymeric material was between 10 and 90 μm. The stirred vessel had a volume of 40 l and was run at an effective volume of 20–30 l. The vessel diameter was 400 mm. A 250 mm diameter toothed disc, which had a plate thickness of 2.5 mm and was provided with 24 teeth on an outer circle and 12 teeth on an inner circle, was used as the stirrer. The length of the teeth was 20 mm and the fleam was 180°. The stirrer plane was 125 mm above the bottom of the vessel. The liquid level depth of the solution in the dissolving vessel was at 300 mm (maximum liquid level at the vessel wall). The toothed disc was driven with a peripheral velocity of about 10 m/sec and the solution was thus maintained at 80° C. A very pronounced stirring vortex was formed, into the center of which the polymer powder and the solvent DMF were continuously charged.

At an average residence time of about 20 minutes, a homogeneous, spinning solution which was free of gel particles and had a viscosity of 1,400 falling-ball seconds corresponding to 186.2 Pas, measured at 60° C. in accordance with DIN 5,401, was obtained. The resulting solution was continuously discharged via a bottom outlet valve and a gear pump of Messrs. Maag-Zahnräder AG, Zürich, Switzerland. This pump delivered 46 $cm^3$/revolution. The spinning solution obtained was then filtered, degassed and passed via a spinning pump to a spinning jet. The solution quality of the solution obtained was checked with the aid of the light-scattering method in accordance with FIG. 2. A 33% strength polymer solution gave the following results:

| Peak height cm | 1 | 2 | 3 | 4 | 5 | 6 | 7 | 8 |
|---|---|---|---|---|---|---|---|---|
| Number of peaks | 2 | 1 | 0 | 0 | 0 | 0 | 0 | 0 |

EXAMPLE 2

4.92 kg/h of dimethylformamide were fed separately from 1.08 kg/h of an acrylonitrile homopolymer into a cylindrical dissolving vessel having a diameter of 130 mm and a capacity of 4 l. The acrylonitrile homopolymer had been obtained by a suspension-precipitation polymerization and had a relative viscosity of 2.9. The stirring vessel had an effective volume of 3 l, which corresponded to a liquid level up to the surface of the stirring vortex of 200 mm. This vessel had a stirrer with a toothed disc of 100 mm diameter and a peripheral velocity of this toothed disc of about 4 m/sec. In this illustrative example the stirrer had been introduced into the stirring vessel from above. The toothed disc had an external diameter of 100 mm and a plate thickness of 2.0 mm, the number of teeth was 10, the length of the teeth was 10 mm and the fleam was 180°. A dissolving temperature of 80° C. was produced with the chosen toothed disc at the speed of rotation. The finished spinning solution was discharged at the bottom with the aid of a gear pump at such a rate that the level in the stirring vessel remained the same. This resulted in an average residence time of the spinning solution in the dissolving vessel of 20 minutes. The 18% strength spinning solution obtained had a viscosity of 220 falling-ball seconds, corresponding to 29.26 Pas, measured at 80° C. After one filtration and a subsequent degassing the spinning solution could be used in spinning. The light-scattering measurement had the following result:

| Peak height cm | 1 | 2 | 3 | 4 | 5 | 6 | 7 | 8 |
|---|---|---|---|---|---|---|---|---|
| Number of peaks | 2 | 0 | 1 | 0 | 0 | 0 | 0 | 0 |

The spinning solution can be termed free from gel particles.

EXAMPLE 3 (Comparison)

1.8 kg of DMF were introduced at room temperature into a 4 l four-necked round-bottomed flask equipped with a horseshoe stirrer. 0.7 kg of an acrylonitrile copolymer, composed of 94.4% of acrylonitrile, 5% of methyl acrylate and 0.6% of sodium methallyl-sulfonate and having a relative viscosity of 1.95, was added via a funnel at a peripheral velocity of the horseshoe stirrer of 0.9 m/sec. The suspension was heated by means of a waterbath at 80° C. After a total stirring time of 3 hours a clear solution having a viscosity of 362 falling-ball seconds (corresponding to 48.1 Pas), measured at 60° C., was obtained. The light-scattering methods gave the following values:

| Peak height cm | 1 | 2 | 3 | 4 | 5 | 6 | 7 | 8 |
|---|---|---|---|---|---|---|---|---|
| Number of peaks | 5 | 3 | 4 | 2 | 1 | 4 | 0 | 0 |

The spinning solution thus obtained has gel particles, which could not be removed to a sufficient extent even by filtration. On spinning, there were spinning disruptions at the jet.

We claim:

1. A continuous process for the production of highly concentrated spinning solutions from acrylonitrile polymers, which consists essentially of dissolving in one step in a stirred mixing vessel, which contains, as the stirrer, only one disc-shaped stirrer rotating in a horizontal plane, the peripheral velocity of which stirrer can be controlled from about 4 to about 25 m/sec, this peripheral velocity being sufficient to stir vigorously, with the formation of a vortex, the solution contained in the stirred mixing vessel, metering in, separately and at room temperature, the polymer to be dissolved and the solvent into the vortex, discharging continuously the finished spinning solution at the bottom of the stirred mixing vessel at such a rate that the liquid level in the vessel is maintained at a constant value, and maintaining the temperature of the solution in the vessel at a constant preset value in the range from about 60 to about 120° C. by controlling the peripheral velocity of the stirrer, the average residence time of the polymer in the vessel being about 5 to 30 minutes.

2. The process as claimed in claim 1, wherein the formation of the vortex is effected by a disc-shaped stirrer, the largest diameter of which is 0.3 to 0.9 times the internal vessel diameter in the stirrer plane and the distance of the disc from the bottom of the vessel is 0.5 to 1 times, the liquid level depth is 0.8 to 3 times, the largest diameter of the stirrer.

3. The process as claimed in claim 1, wherein the viscosity of the spinning solution is between 10 and 200 Pas, preferably between 30 and 100 Pas, within the chosen temperature range.

* * * * *